US012274302B2

(12) United States Patent
Korus et al.

(10) Patent No.: US 12,274,302 B2
(45) Date of Patent: Apr. 15, 2025

(54) AEROSOL GENERATING MATERIAL CHARACTERISTIC DETERMINATION

(71) Applicant: Nicoventures Trading Limited, London (GB)

(72) Inventors: Anton Korus, London (GB); Justin Chan, London (GB); Patrick Moloney, London (GB)

(73) Assignee: NICOVENTURES TRADING LIMITED, London (GB)

( * ) Notice: Subject to any disclaimer, the term of this patent is extended or adjusted under 35 U.S.C. 154(b) by 972 days.

(21) Appl. No.: 17/271,514

(22) PCT Filed: Aug. 30, 2019

(86) PCT No.: PCT/EP2019/073263
§ 371 (c)(1),
(2) Date: Feb. 25, 2021

(87) PCT Pub. No.: WO2020/043904
PCT Pub. Date: Mar. 5, 2020

(65) Prior Publication Data

US 2021/0169146 A1 Jun. 10, 2021

(30) Foreign Application Priority Data

Aug. 31, 2018 (GB) ..... 1814197

(51) Int. Cl.
*A24F 47/00* (2020.01)
*A24F 40/10* (2020.01)
(Continued)

(52) U.S. Cl.
CPC ..... *A24F 40/465* (2020.01); *A24F 40/10* (2020.01); *A24F 40/53* (2020.01)

(58) Field of Classification Search
CPC ..... A24F 40/465; A24F 40/10; A24F 40/53; A24F 40/60; A24F 40/50; H05B 6/02; H05B 6/06
See application file for complete search history.

(56) References Cited

U.S. PATENT DOCUMENTS 174,884 A 3/1876 Wolff
239,198 A 3/1881 Simonds
(Continued)

FOREIGN PATENT DOCUMENTS

AU 2019333557 A1 5/2021
CN 86102917 A 11/1987
(Continued)

OTHER PUBLICATIONS

Application and File History for U.S. Appl. No. 16/320,598, filed Jan. 25, 2019, Inventors Ballesteros Gomez et al.
(Continued)

*Primary Examiner* — Abdullah A Riyami
*Assistant Examiner* — Nelson R. Burgos-Guntin
(74) *Attorney, Agent, or Firm* — Husch Blackwell

(57) ABSTRACT

Apparatus and methods for determining a characteristic of an aerosol generating material of an aerosol generating device are disclosed. The aerosol generating device comprises a heater for heating of the aerosol generating material in use. The apparatus is arranged to monitor a first property of the heating of the aerosol generating material, thereby to determine a heating profile of the aerosol generating material; analyse the heating profile to identify a feature of the heating profile corresponding to a heating of one or more constituents of the aerosol generating material; and determine, based on the identified one or more features, the characteristic of the aerosol generating material.

28 Claims, 4 Drawing Sheets

(51) Int. Cl.
*A24F 40/465* (2020.01)
*A24F 40/53* (2020.01)

(56) References Cited

U.S. PATENT DOCUMENTS 239,776 A 4/1881 Henley
D22,270 S 3/1893 Marshall
D27,458 S 8/1897 Alexander
844,272 A 2/1907 Fate
912,986 A 2/1909 Aschenbrenner
1,071,817 A 9/1913 Stanley
1,771,366 A 7/1930 Wyss et al.
1,886,391 A 11/1932 Henri et al.
1,927,956 A 9/1933 Samuel et al.
2,104,266 A 1/1938 McCormick
2,371,557 A 3/1945 Sullivan
3,225,954 A 12/1965 Herrick et al.
3,265,236 A 8/1966 Norman et al.
3,804,100 A 4/1974 Fariello
3,805,806 A 4/1974 Grihalva
3,889,690 A 6/1975 Guarnieri
D239,776 S 5/1976 Kenjiro
4,171,000 A 10/1979 Uhle
4,214,658 A 7/1980 Crow
4,303,083 A 12/1981 Burruss, Jr.
4,474,191 A 10/1984 Steiner
4,588,976 A 5/1986 Jaselli
D284,506 S 7/1986 Gutknecht
4,628,187 A 12/1986 Sekiguchi et al.
4,638,820 A 1/1987 Roberts et al.
4,675,508 A 6/1987 Miyaji et al.
4,735,217 A 4/1988 Gerth et al.
4,756,318 A 7/1988 Clearman et al.
4,765,347 A 8/1988 Sensabaugh, Jr. et al.
D303,766 S 10/1989 Delbanco
4,907,606 A 3/1990 Lilja et al.
4,922,901 A 5/1990 Brooks et al.
4,945,929 A 8/1990 Egilmex
4,945,931 A 8/1990 Gori
4,947,874 A 8/1990 Brooks et al.
4,947,875 A 8/1990 Brooks et al.
5,040,551 A 8/1991 Schlatter et al.
5,060,671 A 10/1991 Counts et al.
5,093,894 A 3/1992 Deevi et al.
5,095,921 A 3/1992 Losee et al.
5,144,962 A 9/1992 Counts et al.
5,179,966 A 1/1993 Losee et al.
5,190,060 A 3/1993 Gerding et al.
5,203,355 A 4/1993 Clearman et al.
5,224,498 A 7/1993 Deevi et al.
5,247,947 A 9/1993 Clearman et al.
5,249,586 A 10/1993 Morgan et al.
5,251,688 A 10/1993 Schatz
5,261,424 A 11/1993 Sprinkel, Jr.
5,269,327 A 12/1993 Counts et al.
5,271,980 A 12/1993 Bell
5,285,798 A 2/1994 Banerjee et al.
5,303,720 A 4/1994 Banerjee et al.
5,322,075 A 6/1994 Deevi et al.
5,327,915 A 7/1994 Porenski et al.
5,331,979 A 7/1994 Henley
5,345,951 A 9/1994 Serrano et al.
5,353,813 A 10/1994 Deevi et al.
5,369,723 A 11/1994 Counts et al.
5,388,594 A 2/1995 Counts et al.
5,402,803 A 4/1995 Takagi
5,408,574 A 4/1995 Deevi et al.
D360,281 S 7/1995 Kim
5,468,936 A 11/1995 Deevi et al.
5,505,214 A 4/1996 Collins et al.
5,564,442 A 10/1996 Macdonald et al.
5,573,140 A 11/1996 Satomi et al.
5,613,504 A 3/1997 Collins et al.
5,613,505 A 3/1997 Campbell et al.
5,665,262 A 9/1997 Hajaligol et al.
5,771,845 A 6/1998 Pistien et al.
5,798,154 A 8/1998 Bryan
5,865,186 A 2/1999 Volsey, II
5,878,752 A 3/1999 Adams et al.
6,026,820 A 2/2000 Baggett, Jr. et al.
D422,113 S 3/2000 Higgins et al.
6,037,568 A 3/2000 Hatanaka et al.
6,040,560 A 3/2000 Fleischhauer et al.
D424,236 S 5/2000 Reed
6,089,857 A 7/2000 Matsuura et al.
6,125,853 A 10/2000 Susa et al.
6,155,268 A 12/2000 Takeuchi
D437,112 S 2/2001 Toffoli
D446,849 S 8/2001 Weinberg
6,315,366 B1 11/2001 Post et al.
6,376,816 B2 4/2002 Cooper et al.
6,868,230 B2 3/2005 Gerhardinger
D506,001 S 6/2005 Christianson
D512,493 S 12/2005 Haranaka
6,994,096 B2 2/2006 Rostami et al.
D538,222 S 3/2007 Curello et al.
D558,330 S 12/2007 Chang
7,374,063 B2 5/2008 Reid
D576,718 S 9/2008 Nomi et al.
7,624,739 B2 12/2009 Snaidr et al.
D634,417 S 3/2011 Abbondanzio et al.
D634,832 S 3/2011 Abbondanzio et al.
7,913,688 B2 3/2011 Cross et al.
D643,732 S 8/2011 Cummings et al.
7,988,660 B2 8/2011 Byland et al.
D645,757 S 9/2011 Milhem et al.
8,061,361 B2 11/2011 Maeder et al.
D650,472 S 12/2011 Petersen
8,079,371 B2 12/2011 Robinson et al.
8,081,474 B1 12/2011 Zohni et al.
D654,160 S 2/2012 Yomtov
D663,891 S 7/2012 Cohen Harel
D664,709 S 7/2012 Almsberger et al.
D665,734 S 8/2012 Fitch et al.
D674,479 S 1/2013 Merchant et al.
D677,623 S 3/2013 Fitch et al.
D677,774 S 3/2013 Postma
8,528,780 B2 9/2013 Houghton et al.
D695,396 S 12/2013 Tani et al.
D696,815 S 12/2013 Abroff
D700,397 S 2/2014 Manca et al.
8,678,013 B2 3/2014 Crooks et al.
D704,319 S 5/2014 Cai
8,757,404 B1 6/2014 Fleckenstein
D708,129 S 7/2014 Houghton et al.
D708,727 S 7/2014 Postma
8,807,140 B1 8/2014 Scatterday
8,833,364 B2 9/2014 Buchberger
D714,647 S 10/2014 Kersten
D715,760 S 10/2014 Kim et al.
D716,267 S 10/2014 Kim et al.
D728,855 S 5/2015 Liu
D729,440 S 5/2015 Liu
D729,445 S 5/2015 Leidel
D736,455 S 8/2015 Liu
D740,673 S 10/2015 Corradini et al.
D743,099 S 11/2015 Oglesby
D743,889 S 11/2015 Lyles et al.
D745,404 S 12/2015 Julier et al.
D746,771 S 1/2016 Perez
D758,656 S 6/2016 Freshwater et al.
D759,296 S 6/2016 Abroff et al.
D760,414 S 6/2016 Brown et al.
9,357,803 B2 6/2016 Egoyants et al.
9,414,629 B2 8/2016 Egoyants et al.
D768,834 S 10/2016 Schuller et al.
D771,867 S 11/2016 Leidel et al.
D773,114 S 11/2016 Leidel et al.
D775,762 S 1/2017 Chen
9,554,598 B2 1/2017 Egoyants et al.
D778,831 S 2/2017 Chen
9,609,894 B2 4/2017 Abramov et al.
D787,657 S 5/2017 Farone et al.
D787,728 S 5/2017 Wing et al.

(56) References Cited

U.S. PATENT DOCUMENTS

D788,364 S 5/2017 Chen
D807,575 S 1/2018 Luo
D818,637 S 5/2018 Ringel
D819,023 S 5/2018 Shim
9,980,523 B2 5/2018 Abramov et al.
D821,640 S 6/2018 Qiu
9,999,256 B2 6/2018 Abramov et al.
D828,295 S 9/2018 Li
D828,622 S 9/2018 Chen et al.
D828,912 S 9/2018 Powell et al.
D828,950 S 9/2018 Gu
D828,953 S 9/2018 Chen
D833,384 S 11/2018 Takayanagi
10,136,679 B1 11/2018 Shotey et al.
D835,857 S 12/2018 Benacquisto et al.
D839,823 S 2/2019 Lemelson et al.
D842,237 S 3/2019 Qiu et al.
D842,243 S 3/2019 Qiu
D843,052 S 3/2019 Powell et al.
D848,603 S 5/2019 Fujino et al.
D854,236 S 7/2019 Qiu
D861,549 S 10/2019 Lai
D869,086 S 12/2019 Pan
D870,367 S 12/2019 Chung et al.
D872,355 S 1/2020 Powell et al.
D876,214 S 2/2020 Yu
D881,458 S 4/2020 Ouyang
D883,197 S 5/2020 Doucet
D883,563 S 5/2020 Pan
D884,266 S 5/2020 Wang
D885,332 S 5/2020 Han
D885,337 S 5/2020 Xu
D885,651 S 5/2020 Miyamoto
D888,326 S 6/2020 Qiu
D888,329 S 6/2020 Qiu
D889,740 S 7/2020 Beer et al.
D891,692 S 7/2020 Barbaric et al.
D892,124 S 8/2020 Shim
D893,009 S 8/2020 Choi
D894,476 S 8/2020 Miyamoto
D897,596 S 9/2020 Huang et al.
D898,990 S 10/2020 Liu et al.
D898,991 S 10/2020 Pan
2002/0005207 A1 1/2002 Wrenn et al.
2002/0079309 A1 6/2002 Cox et al.
2003/0049025 A1 3/2003 Neumann et al.
2003/0146224 A1 8/2003 Fujii et al.
2004/0003820 A1 1/2004 Iannuzzi
2004/0025865 A1 2/2004 Nichols et al.
2004/0096204 A1 5/2004 Gerhardinger
2004/0149296 A1 8/2004 Rostami et al.
2004/0149297 A1 8/2004 Sharpe
2004/0149737 A1 8/2004 Sharpe et al.
2005/0063686 A1 3/2005 Whittle et al.
2005/0199610 A1 9/2005 Ptasienski et al.
2005/0211711 A1 9/2005 Reid
2005/0268911 A1 12/2005 Cross et al.
2007/0074734 A1 4/2007 Braunshteyn et al.
2007/0102013 A1 5/2007 Adams et al.
2007/0155255 A1 7/2007 Galauner et al.
2007/0204858 A1 9/2007 Abelbeck
2007/0204868 A1 9/2007 Bollinger et al.
2007/0283972 A1 12/2007 Monsees et al.
2008/0085139 A1 4/2008 Roof
2008/0092912 A1 4/2008 Robinson et al.
2008/0216828 A1 9/2008 Wensley et al.
2008/0233318 A1 9/2008 Coyle
2008/0302374 A1 12/2008 Wengert et al.
2009/0032034 A1 2/2009 Steinberg
2009/0056728 A1 3/2009 Baker
2009/0114737 A1 5/2009 Yu et al.
2009/0126745 A1 5/2009 Hon
2009/0151717 A1 6/2009 Bowen et al.
2009/0260641 A1 10/2009 Monsees et al.
2009/0272379 A1 11/2009 Thorens et al.
2009/0304372 A1 12/2009 Gubler et al.
2010/0126516 A1 5/2010 Yomtov et al.
2010/0200006 A1 8/2010 Robinson et al.
2010/0236561 A1 9/2010 Barnes et al.
2010/0242975 A1 9/2010 Hearn
2010/0300467 A1 12/2010 Kuistila et al.
2011/0094523 A1 4/2011 Thorens et al.
2011/0108025 A1 5/2011 Fink et al.
2011/0126848 A1 6/2011 Zuber et al.
2011/0155153 A1 6/2011 Thorens et al.
2011/0226236 A1 9/2011 Buchberger
2011/0240047 A1 10/2011 Adamic
2011/0264084 A1 10/2011 Reid
2011/0290244 A1 12/2011 Schennum
2012/0006342 A1 1/2012 Rose et al.
2012/0255546 A1 10/2012 Goetz et al.
2012/0260927 A1 10/2012 Liu
2013/0042865 A1 2/2013 Monsees et al.
2013/0081623 A1 4/2013 Buchberger
2013/0255702 A1 10/2013 Griffith, Jr. et al.
2013/0306084 A1 11/2013 Flick
2014/0060554 A1 3/2014 Collett et al.
2014/0069444 A1 3/2014 Cyphert et al.
2014/0182608 A1 7/2014 Egoyants et al.
2014/0182843 A1 7/2014 Vinegar
2014/0196718 A1 7/2014 Li et al.
2014/0202476 A1 7/2014 Egoyants et al.
2014/0216485 A1 8/2014 Egoyants et al.
2014/0270726 A1 9/2014 Egoyants et al.
2014/0270729 A1* 9/2014 DePiano ..... A24F 40/46 392/397
2014/0283825 A1 9/2014 Buchberger
2014/0299125 A1 10/2014 Buchberger
2014/0305449 A1 10/2014 Plojoux et al.
2014/0326257 A1 11/2014 Jalloul et al.
2014/0334802 A1 11/2014 Dubief
2014/0338680 A1 11/2014 Abramov et al.
2014/0360515 A1 12/2014 Vasiliev et al.
2014/0366898 A1 12/2014 Monsees et al.
2015/0040925 A1 2/2015 Saleem et al.
2015/0053217 A1 2/2015 Steingraber et al.
2015/0059787 A1 3/2015 Qiu
2015/0101606 A1 4/2015 White
2015/0101944 A1 4/2015 Li et al.
2015/0181937 A1 7/2015 Dubief et al.
2015/0189919 A1 7/2015 Liu
2015/0223520 A1 8/2015 Phillips et al.
2015/0245658 A1 9/2015 Worm et al.
2015/0245659 A1* 9/2015 DePiano ..... B21D 53/06 392/397
2015/0257445 A1* 9/2015 Henry, Jr. ..... A24F 40/50 131/328
2016/0003403 A1 1/2016 Smith
2016/0007652 A1 1/2016 Taluskie et al.
2016/0081395 A1 3/2016 Thorens et al.
2016/0234886 A1* 8/2016 Laghi ..... H01R 11/32
2016/0255879 A1 9/2016 Paprocki et al.
2016/0331022 A1* 11/2016 Cameron ..... A24F 40/485
2016/0331026 A1* 11/2016 Cameron ..... A24F 40/50
2016/0331034 A1* 11/2016 Cameron ..... A61M 15/0003
2016/0331037 A1* 11/2016 Cameron ..... A24F 40/50
2016/0331859 A1* 11/2016 Cameron ..... A24F 40/51
2016/0334847 A1* 11/2016 Cameron ..... A24F 40/65
2017/0020188 A1* 1/2017 Cameron ..... A24F 40/60
2017/0020196 A1* 1/2017 Cameron ..... A24F 40/60
2017/0027229 A1* 2/2017 Cameron ..... H04L 67/12
2017/0119048 A1 5/2017 Kaufman et al.
2017/0119049 A1 5/2017 Blandino et al.
2017/0119050 A1 5/2017 Blandino et al.
2017/0156406 A1 6/2017 Abramov et al.
2017/0156407 A1 6/2017 Abramov et al.
2017/0164657 A1 6/2017 Batista
2017/0197043 A1 7/2017 Buchberger
2017/0197044 A1 7/2017 Buchberger
2017/0197046 A1 7/2017 Buchberger
2017/0231276 A1 8/2017 Mironov et al.
2017/0232211 A1 8/2017 Gallem et al.
2017/0238610 A1* 8/2017 Reevell ..... G06F 1/04
2017/0303592 A1* 10/2017 Cameron ..... A24F 40/53

(56) References Cited

U.S. PATENT DOCUMENTS

| | | | |
|---|---|---|---|
| 2017/0340015 | A1* | 11/2017 | Thorens ..... A24F 40/44 |
| 2018/0168224 | A1 | 6/2018 | Naughton et al. |
| 2018/0271151 | A1 | 9/2018 | Litten |
| 2018/0271153 | A1 | 9/2018 | John et al. |
| 2018/0271171 | A1 | 9/2018 | Abramov et al. |
| 2019/0029326 | A1 | 1/2019 | Qiu |
| 2019/0046745 | A1 | 2/2019 | Nettenstrom et al. |
| 2019/0150508 | A1 | 5/2019 | Thorsen et al. |
| 2019/0159517 | A1 | 5/2019 | Ballesteros Gomez et al. |
| 2019/0166918 | A1 | 6/2019 | Thorsen et al. |
| 2019/0200678 | A1 | 7/2019 | Thorson et al. |
| 2019/0208815 | A1 | 7/2019 | Thorsen |
| 2019/0208816 | A1 | 7/2019 | Thorsen |
| 2019/0208817 | A1 | 7/2019 | Qiu et al. |
| 2019/0246693 | A1 | 8/2019 | Nettenstrom et al. |
| 2019/0387799 | A1 | 12/2019 | Reevell |
| 2020/0245681 | A1 | 8/2020 | An |
| 2020/0345960 | A1 | 11/2020 | Begin et al. |
| 2021/0169146 | A1 | 6/2021 | Korus et al. |

FOREIGN PATENT DOCUMENTS

| | | | |
|---|---|---|---|
| CN | 1040914 | A | 4/1990 |
| CN | 1045691 | A | 10/1990 |
| CN | 1122213 | A | 5/1996 |
| CN | 1126425 | A | 7/1996 |
| CN | 2246744 | Y | 2/1997 |
| CN | 1190335 | A | 8/1998 |
| CN | 1196660 | A | 10/1998 |
| CN | 1196661 | A | 10/1998 |
| CN | 1333657 | A | 1/2002 |
| CN | 2598364 | Y | 1/2004 |
| CN | 1947462 | A | 4/2007 |
| CN | 101044795 | A | 9/2007 |
| CN | 101238047 | A | 8/2008 |
| CN | 101267749 | A | 9/2008 |
| CN | 101277622 | A | 10/2008 |
| CN | 201185656 | Y | 1/2009 |
| CN | 101557728 | A | 10/2009 |
| CN | 201375023 | Y | 1/2010 |
| CN | 101925309 | A | 12/2010 |
| CN | 201869778 | U | 6/2011 |
| CN | 102595943 | A | 7/2012 |
| CN | 102753047 | A | 10/2012 |
| CN | 103359550 | A | 10/2013 |
| CN | 103763953 | A | 4/2014 |
| CN | 103763954 | A | 4/2014 |
| CN | 103974639 | A | 8/2014 |
| CN | 103997921 | A | 8/2014 |
| CN | 104095291 | A | 10/2014 |
| CN | 104768407 | A | 7/2015 |
| CN | 105307524 | A | 2/2016 |
| CN | 106455714 | A | 2/2017 |
| CN | 304659647 | | 6/2018 |
| CN | 304659654 | | 6/2018 |
| CN | 304691359 | | 6/2018 |
| CN | 304696494 | | 6/2018 |
| CN | 304724787 | | 7/2018 |
| CN | 304840668 | | 10/2018 |
| CN | 111432669 | A | 7/2020 |
| DE | 29713866 | U1 | 10/1997 |
| DE | 19854005 | A1 | 5/2000 |
| DE | 19854009 | A1 | 5/2000 |
| EM | 0026114260001 | | 3/2015 |
| EM | EU0027270990001 | | 9/2017 |
| EM | EU0027270990007 | | 9/2017 |
| EP | 0358002 | A2 | 3/1990 |
| EP | 0358114 | A2 | 3/1990 |
| EP | 0430559 | A2 | 6/1991 |
| EP | 0430566 | A2 | 6/1991 |
| EP | 0438862 | A2 | 7/1991 |
| EP | 0488488 | A1 | 6/1992 |
| EP | 0503767 | A1 | 9/1992 |
| EP | 0603613 | A1 | 6/1994 |
| EP | 0703735 | A1 | 4/1996 |
| EP | 0845220 | A1 | 6/1998 |
| EP | 1618803 | A1 | 1/2006 |
| EP | 1736065 | A1 | 12/2006 |
| EP | 2022349 | A1 | 2/2009 |
| EP | 2110033 | A1 | 10/2009 |
| EP | 1947965 | B1 | 2/2010 |
| EP | 2316286 | A1 | 5/2011 |
| EP | 2327318 | A1 | 6/2011 |
| EP | 2340729 | A1 | 7/2011 |
| EP | 2340730 | A1 | 7/2011 |
| EP | 2394520 | A1 | 12/2011 |
| EP | 2520186 | A1 | 11/2012 |
| EP | 2797448 | A2 | 11/2014 |
| EP | 3843567 | A1 | 7/2021 |
| GB | 191000639 | A | 12/1910 |
| GB | 191126138 | A | 3/1912 |
| GB | 426247 | A | 3/1935 |
| JP | S62501050 | A | 4/1987 |
| JP | S63127399 | U | 8/1988 |
| JP | H03192677 | A | 8/1991 |
| JP | H03232481 | A | 10/1991 |
| JP | H05212100 | A | 8/1993 |
| JP | H0590161 | U | 12/1993 |
| JP | H06189861 | A | 7/1994 |
| JP | H06315366 | A | 11/1994 |
| JP | H08942 | U | 6/1996 |
| JP | H09107943 | A | 4/1997 |
| JP | H1189551 | A | 4/1999 |
| JP | H11125390 | A | 5/1999 |
| JP | H11169157 | A | 6/1999 |
| JP | 2001521123 | A | 11/2001 |
| JP | 2003527127 | A | 9/2003 |
| JP | 2005036897 | A | 2/2005 |
| JP | 2005106350 | A | 4/2005 |
| JP | 2005300005 | A | 10/2005 |
| JP | 2006501871 | A | 1/2006 |
| JP | 2008249003 | A | 10/2008 |
| JP | 2009509521 | A | 3/2009 |
| JP | 2009537120 | A | 10/2009 |
| JP | 2010506594 | A | 3/2010 |
| JP | 2010178730 | A | 8/2010 |
| JP | 2010213579 | A | 9/2010 |
| JP | 2011058538 | A | 3/2011 |
| JP | 2011509667 | A | 3/2011 |
| JP | 2013509160 | A | 3/2013 |
| JP | 5193668 | B2 | 5/2013 |
| JP | 2014501105 | A | 1/2014 |
| JP | 2014519586 | A | 8/2014 |
| JP | 2014524313 | A | 9/2014 |
| JP | 2014525251 | A | 9/2014 |
| JP | 2014533513 | A | 12/2014 |
| JP | 2015513922 | A | 5/2015 |
| JP | 2015521847 | A | 8/2015 |
| JP | 2021534792 | A | 12/2021 |
| KR | 0178388 | B1 | 2/1999 |
| KR | 19990081973 | A | 11/1999 |
| KR | 20010089445 | A | 10/2001 |
| KR | 100495099 | B1 | 11/2005 |
| KR | 100636287 | B1 | 10/2006 |
| KR | 100757450 | B1 | 9/2007 |
| KR | 20080060218 | A | 7/2008 |
| KR | 20100135865 | A | 12/2010 |
| KR | 20120104533 | A | 9/2012 |
| KR | 20140070588 | A | 6/2014 |
| KR | 20180012830 | A | 2/2018 |
| KR | 20180070515 | A | 6/2018 |
| KR | 20210058862 | A | 5/2021 |
| RU | 2600092 | C2 | 10/2016 |
| UZ | 2238 | C | 12/2002 |
| WO | WO-8602528 | A1 | 5/1986 |
| WO | WO-9219081 | A1 | 10/1992 |
| WO | WO-9406314 | A1 | 3/1994 |
| WO | WO-9418860 | A1 | 9/1994 |
| WO | WO-9632854 | A2 | 10/1996 |
| WO | WO-9741744 | A1 | 11/1997 |
| WO | WO-9748295 | A1 | 12/1997 |
| WO | WO-9823171 | A1 | 6/1998 |
| WO | WO-9920939 | A1 | 4/1999 |
| WO | WO-0027232 | A1 | 5/2000 |

(56) References Cited

FOREIGN PATENT DOCUMENTS

| | | | |
|---|---|---|---|
| WO | WO-0167819 | A1 | 9/2001 |
| WO | WO-0170054 | A1 | 9/2001 |
| WO | WO-03012565 | A1 | 2/2003 |
| WO | WO-03037412 | A2 | 5/2003 |
| WO | WO-03059413 | A2 | 7/2003 |
| WO | WO-03070031 | A1 | 8/2003 |
| WO | WO-03103387 | A2 | 12/2003 |
| WO | WO-2007012007 | A2 | 1/2007 |
| WO | WO-2007017482 | A1 | 2/2007 |
| WO | WO-2007039794 | A2 | 4/2007 |
| WO | WO-2007131450 | A1 | 11/2007 |
| WO | WO-2008108889 | A1 | 9/2008 |
| WO | WO-2008121610 | A1 | 10/2008 |
| WO | WO-2009001082 | A1 | 12/2008 |
| WO | WO-2009022232 | A2 | 2/2009 |
| WO | WO-2009092862 | A1 | 7/2009 |
| WO | WO-2010047389 | A1 | 4/2010 |
| WO | WO-2010073018 | A1 | 7/2010 |
| WO | WO-2010107613 | A1 | 9/2010 |
| WO | WO-2010118644 | A1 | 10/2010 |
| WO | WO-2010133342 | A1 | 11/2010 |
| WO | WO-2011050964 | A1 | 5/2011 |
| WO | WO-2011063970 | A1 | 6/2011 |
| WO | WO-2011068020 | A1 | 6/2011 |
| WO | WO-2011079932 | A1 | 7/2011 |
| WO | WO-2013022936 | A1 | 2/2013 |
| WO | WO-2013025921 | A1 | 2/2013 |
| WO | WO-2013034454 | A1 | 3/2013 |
| WO | WO-2013034458 | A1 | 3/2013 |
| WO | WO-2013034459 | A1 | 3/2013 |
| WO | WO-2013034460 | A1 | 3/2013 |
| WO | WO-2013076098 | A2 | 5/2013 |
| WO | WO-2013098395 | A1 | 7/2013 |
| WO | WO-2013098396 | A2 | 7/2013 |
| WO | WO-2013098397 | A2 | 7/2013 |
| WO | WO-2013131764 | A1 | 9/2013 |
| WO | WO-2013160112 | A2 | 10/2013 |
| WO | WO-2014102092 | A1 | 7/2014 |
| WO | WO-2014201432 | A1 | 12/2014 |
| WO | WO-2015062983 | A2 | 5/2015 |
| WO | WO-2015071682 | A1 | 5/2015 |
| WO | WO-2015091258 | A1 | 6/2015 |
| WO | WO-2015166245 | A2 | 11/2015 |
| WO | WO-2015177254 | A1 | 11/2015 |
| WO | WO-2016005533 | A1 | 1/2016 |
| WO | WO-2016012774 | A1 | 1/2016 |
| WO | WO 2015/177257 | A1 | 11/2016 |
| WO | WO-2016207407 | A1 | 12/2016 |
| WO | WO-2017194762 | A1 | 11/2017 |
| WO | WO-2017194763 | A2 | 11/2017 |
| WO | WO-2017194764 | A1 | 11/2017 |
| WO | WO-2017194766 | A1 | 11/2017 |
| WO | WO-2017194769 | A1 | 11/2017 |
| WO | 2017207673 | A1 | 12/2017 |
| WO | WO-2018002086 | A1 | 1/2018 |
| WO | WO 2018/019855 | A1 | 2/2018 |
| WO | WO-2018019786 | A1 | 2/2018 |
| WO | WO 2018/050701 | A1 | 3/2018 |
| WO | 2019129845 | A1 | 7/2019 |
| WO | 2020043904 | A1 | 3/2020 |

OTHER PUBLICATIONS

Application and File History for U.S. Patent Application for U.S. Appl. No. 29/676,726, filed Jan. 14, 2019, 98 pages, inventor(s): Powell et al.
Application and File History for U.S. Appl. No. 16/099,315, filed Nov. 6, 2018, Inventor: Thorsen, 222 pages.
Application and File History for U.S. Appl. No. 13/583,381, filed Dec. 17, 2012, inventor Buchberger.
Application and File History for U.S. Appl. No. 14/127,138, filed Feb. 10, 2014, inventors Egoyants et al.
Application and File History for U.S. Appl. No. 14/127,144, filed Mar. 31, 2014, inventors Egoyants et al.
Application and File History for U.S. Appl. No. 14/127,148, filed Mar. 12, 2014, inventors Egoyants et al.
Application and File History for U.S. Appl. No. 14/127,879, filed May 9, 2014, inventors Egoyants et al.
Application and File History for U.S. Appl. No. 14/343,368, filed Jun. 24, 2014, inventors Abramov et al.
Application and File History for U.S. Appl. No. 14/382,198, filed Aug. 29, 2014, inventors Saleem et al.
Application and Filing Receipt for U.S. Appl. No. 29/557,914, filed Mar. 14, 2016, 280 pages, inventor(s): Powell et al.
Collier J.G et al., "10.3 Mechanism of Evaporation and Condensation," Convective Boiling and Condensation, Third Edition, Clarendon Press, 1994, 6 pages.
Concept Group, "Insulon® Thermal Barrier from Concept Group Blocks Heat with Hyper-Deep Vacuum™," Dec. 15, 2011, 1 page.
Davies, et al., "Metallic Foams: Their Production, Properties and Applications," Journal of Materials Science, 1983, vol. 18(7), pp. 1899-1911.
Decision to Grant a Patent mailed Nov. 15, 2016 for Japanese Application No. 2015-506185 filed Apr. 11, 2013, 5 pages.
Decision to Grant mailed Jan. 18, 2017 for Russian Application No. 2016503074, 4 pages.
English Translation of Office Action mailed Dec. 25, 2018 for Korean Application No. 10-2017-7037332, 7 pages.
Examination Report mailed Jan. 9, 2019 for Philippines Application No. 1/2016/500805, 6 pages.
Examination Report mailed Feb. 21, 2018 for Australian Application No. 2016204192, 7 pages.
Examination Report No.1 for Australian Patent Application No. 2019333557, mailed Dec. 17, 2021, 6 pages.
Extended European Search Report for Application No. 21162875.5, mailed on Oct. 6, 2021, 15 pages.
First Office Action mailed Jun. 15, 2015 and Search Report mailed Jun. 2, 2015 for Chinese Application No. 201280029784.X, filed Aug. 24, 2012, 27 pages.
First Office Action mailed Dec. 3, 2015 for Chinese Application No. 201380021387.2, filed Apr. 11, 2011, 20 pages.
"Glo E-cigarette", published 2016, retrieved from https://ifworlddesignguide.com/entry/235574-glo onMay 12, 2020, 4 pages.
U.S. Appl. No. 29/687,461, filed Apr. 12, 2019, inventor(s): Powell et al.
U.S. Appl. No. 29/687,464, filed Apr. 12, 2019, inventor(s): Powell et al.
U.S. Appl. No. 29/687,469, filed Apr. 12, 2019, inventor(s): Powell et al.
U.S. Appl. No. 29/687,471, filed Apr. 12, 2019, inventor(s): Powell et al.
Design U.S. Appl. No. 29/705,487, filed Sep. 12, 2019 inventor(s): Powell et al.
U.S. Appl. No. 15/737,673, filed Dec. 18, 2017, inventor(s): Thorsen et al.
International Preliminary Report on Patentability for Application No. PCT/EP2017/068804, mailed on Feb. 7, 2019, 8 pages.
International Preliminary Report on Patentability for Application No. PCT/EP2012/066484, mailed on Mar. 20, 2014, 7 pages.
International Preliminary Report on Patentability for Application No. PCT/EP2017/061518, mailed on Aug. 17, 2018, 16 pages.
International Preliminary Report on Patentability for Application No. PCT/EP2017/061519, mailed on Jul. 25, 2018, 22 pages.
International Preliminary Report on Patentability for Application No. PCT/EP2017/061526, mailed on Nov. 22, 2018, 10 pages.
International Preliminary Report on Patentability for Application No. PCT/EP2017/068675, mailed on Nov. 29, 2018, 7 pages.
International Preliminary Report on Patentability for International Application No. PCT/EP2017/061520, mailed on Jul. 17, 2018, 11 pages.
International Preliminary Report on Patentability for International Application No. PCT/EP2017/061523, mailed on Jul. 23, 2018, 14 pages.
International Preliminary Report on Patentability for Application No. PCT/EP2012/066486, mailed on Oct. 22, 2013, 10 pages.
International Preliminary Report on Patentability for Application No. PCT/EP2012/066523, mailed on Nov. 4, 2013, 9 pages.

(56) References Cited

OTHER PUBLICATIONS

International Preliminary Report on Patentability for Application No. PCT/EP2012/066524, mailed on Oct. 17, 2013, 11 pages.
International Search Report and Written Opinion for Application No. PCT/EP2013/057539, mailed on Feb. 11, 2014, 16 pages.
International Search Report and Written Opinion for Application No. PCT/EP2017/061519, mailed on Dec. 15, 2017, 22 pages.
International Search Report and Written Opinion for Application No. PCT/EP2017/061520, mailed on Sep. 11, 2017, 13 pages.
International Search Report and Written Opinion for Application No. PCT/EP2017/061523, mailed on Sep. 11, 2017, 13 pages.
International Search Report and Written Opinion for Application No. PCT/EP2017/068675, mailed on Nov. 9, 2017, 15 pages.
International Search Report and Written Opinion for Application No. PCT/EP2012/066484, mailed on Jan. 9, 2013, 9 pages.
International Search Report and Written Opinion for Application No. PCT/EP2012/066486, mailed on Jan. 14, 2013, 8 pages.
International Search Report and Written Opinion for Application No. PCT/EP2012/066523, mailed on Jan. 9, 2013, 9 pages.
International Search Report and Written Opinion for Application No. PCT/EP2012/066524, mailed on Jan. 9, 2013, 8 pages.
International Search Report and Written Opinion for Application No. PCT/EP2012/066525, mailed on Jan. 9, 2013, 10 pages.
International Search Report and Written Opinion for Application No. PCT/EP2012/066485, mailed on Dec. 10, 2012, 10 pages.
International Search Report and Written Opinion for Application No. PCT/AT2011/000123, mailed on Jul. 18, 2011, 8 pages.
International Search Report for Application No. PCT/EP2016/064756, mailed on Oct. 5, 2016, 2 pages.
International Search Report for Application No. PCT/EP2017/061518, mailed on Aug. 1, 2017, 4 pages.
International Search Report for Application No. PCT/EP2017/061526, mailed on Aug. 2, 2017, 4 pages.
International Search Report for Application No. PCT/EP2017/068804, mailed on Oct. 27, 2017, 5 pages.
National Plastic Heater, Sensor and Control Inc., "Kapton (Polyimide) Flexible Heaters," 2011, retrieved from https://www.kapton-silicone-flexible-heaters.com/products/kapton_polyimide_flexible_heaters.html on Feb. 23, 2018, 2 pages.
Notice of Opposition dated Mar. 7, 2017 for European Application No. 12750770.5, 22 pages.
Notice of Reasons for Refusal mailed Nov. 20, 2018 for Japanese Application No. 2017-567106, 6 pages.
Office Action mailed Jul. 8, 2016 for Chinese Application No. 201380021387.2, filed Apr. 11, 2011, 12 pages.
Office Action mailed Sep. 25, 2018 for European Application No. 12750765.5 filed Aug. 24, 2012, 22 pages.
Office Action mailed Sep. 26, 2018 for European Application No. 12750765.5 filed Aug. 24, 2012, 67 pages.
Office Action mailed Sep. 29, 2015 for Japanese Application No. 2015-506185 filed Apr. 11, 2013, 5 pages.
Office Action mailed Mar. 31, 2015 for Japanese Application No. 2014-519585 filed Aug. 24, 2012, 8 pages.
Office Action mailed Apr. 7, 2015 for Japanese Application No. 2014-519586 filed Aug. 24, 2012, 10 pages.
Office Action and Search Report mailed Apr. 27, 2015 for Chinese Application No. 201280030681.5, filed Aug. 24, 2012, 25 pages.
Office Action For Korean Application No. 10-2021-7023737, mailed on Oct. 20, 2021, 4 pages.
Office Action mailed Sep. 4, 2020 for Korean Application No. 10-2019-7002616, 9 pages.
Office Action mailed Sep. 6, 2017 for Korean Application No. 10-2017-7017425, 9 pages.
Office Action mailed Sep. 6, 2017 for Korean Application No. 10-2017-7017430, 9 pages.
Office Action mailed Jan. 10, 2020 for Indian Application No. 201847042184, 5 pages.
Office Action mailed Mar. 10, 2020 for Japanese Application No. 2018-555932, 10 pages.
Office Action mailed Aug. 17, 2016 for Korean Application No. 10-2014-7032958, 13 pages.
Office Action mailed Aug. 17, 2020 for Chinese Application No. 201780028992.0, 13 pages.
Office Action mailed Feb. 18, 2020 for Japanese Application No. 2018-559712, 6 pages.
Office Action mailed Jul. 20, 2017 for Chilean Application No. 2014-002840, 7 pages.
Office Action mailed Apr. 24, 2019 for Chinese Application No. 201710413187.1, 16 pages.
Office Action mailed Feb. 25, 2020 for Japanese Application No. 2018-554526, 12 pages.
Office Action mailed Dec. 26, 2017 for Chinese Application No. 201480059966.0, 29 pages.
Office Action mailed Jul. 27, 2018 for Korean Application No. 10-2013-7033866, 22 pages.
Office Action mailed Jun. 27, 2017 for Japanese Application No. 2016-527295, 8 pages.
Office Action mailed Aug. 28, 2019 for Indian Application No. 201647014549, 6 pages.
Office Action mailed Jan. 28, 2020 for Japanese Application No. 2018-551932, 6 pages.
Office Action mailed Jul. 28, 2017 for Korean Application No. 10-2016-7010831, 11 pages.
Office Action mailed Jun. 28, 2019 for Russian Application No. 2018139838, 5 pages.
Office Action mailed Jan. 6, 2020 for Chinese Application No. 201680037678.4, 10 pages.
Office Action mailed dated Feb. 25, 2020 for Japanese Application No. 2018-554501, 12 pages.
Office Action mailed on Oct. 15, 2019 for Russian Application No. 2019102040, 8 pages.
Office Action mailed on Mar. 17, 2020 for Japanese Application No. 2019503268, 5 pages.
Office Action mailed on Oct. 20, 2020 for Japanese Application No. 2019503268, 2 pages.
Office Action mailed on Sep. 24, 2020 for Chinese Application No. 201780045799.8, 13 pages.
Patio Kits Direct, "Insulated Roof Panels," DIY Alumawood Patio Cover Kits, dated Sep. 20, 2018, as available at https://www.patiokitsdirect.com/about-insulation, 2 pages.
Search Report mailed Mar. 24, 2015 for Chinese Application No. 201280029767.6 filed Aug. 24, 2012, 6 pages.
Search Report mailed Dec. 25, 2019 for Chinese Application No. 201680037678.4, 2 pages.
Second Office Action mailed Jan. 16, 2017 for Chinese Application No. 201380048636.7, 24 pages.
Translation of Office Action mailed Mar. 25, 2019 for Chinese Application No. 201610804046.8, 17 pages.
Uranaka T., et al., "British American Tobacco to Test Tobacco E-cigarette in Japan," Nov. 8, 2016, Retrieved from http://www.reuters.com/article/us-brit-am-tobacco-ecigarettes-idUSKBN1330AG on Apr. 7, 2017, 4 pages.
Warrier M., et al., "Effect of the Porous Structure of Graphite on Atomic Hydrogen Diffusion and Inventory," Nucl. Fusion, vol. 47, 2007, pp. 1656-1663.
Written Opinion for Application No. PCT/EP2012/066485, mailed on Oct. 15, 2013, 6 pages.
Written Opinion for Application No. PCT/EP2017/061526, mailed on Aug. 2, 2017, 8 pages.
Written Opinion for Application No. PCT/EP2017/068804, mailed on Oct. 27, 2017, 6 pages.
International Search Report and Written Opinion for PCT/EP2019/073263, Nov. 26, 2019, 12 pages.
"Notice of Allowance received for Australian Patent Application No. 2023200214, mailed on May 30, 2024", 3 pages.
"Office Action received for Chinese Patent Application No. 201980056613.8, mailed on May 30, 2024", 11 pages (6 pages of English Translation and 5 pages of Official Copy).
"Examination Report No. 2 for Australian Patent Application No. 2019333557, mailed on Jul. 1, 2022", 4 pages.

(56) References Cited

OTHER PUBLICATIONS

"Notice of Reason for Refusal received for Japanese Application No. 2021-510939, mailed on Jul. 25, 2023", 6 pages (3 pages of English Translation and 3 pages of Official Copy Only).
"Office Action received for Canadian Patent Application No. 3,110,758, mailed on May 25, 2022", 5 pages.
"Office Action received for Israeli Application No. 281026, mailed on Aug. 9, 2023", 4 pages (English Translation Only).
"Office Action reeived for Chinese Patent Application No. 201980056613.8, mailed Aug. 31, 2024", 6 pages (English Translation Only).

* cited by examiner

AEROSOL GENERATING MATERIAL CHARACTERISTIC DETERMINATION

PRIORITY CLAIM

The present application is a National Phase entry of PCT Application No. PCT/EP2019/073263, filed Aug. 30, 2019 which claims priority from GB Patent Application No. 1814197.8, filed Aug. 31, 2018, each of which is hereby fully incorporated herein by reference.

TECHNICAL FIELD

The present invention relates to determining characteristics of an aerosol generating material, and more particularly to determining characteristics of an aerosol generating material of an aerosol generating device.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to a first aspect of the present invention, there is provided apparatus for determining a characteristic of an aerosol generating material of an aerosol generating device, the aerosol generating device comprising a heater for heating of the aerosol generating material in use; the apparatus being arranged to: monitor a first property of the heating of the aerosol generating material, thereby to determine a heating profile of the aerosol generating material; analyse the heating profile to identify a feature of the heating profile corresponding to a heating of one or more constituents of the aerosol generating material; and determine, based on the identified one or more features, the characteristic of the aerosol generating material.

Optionally, the apparatus is arranged to analyse the heating profile to identify a feature of the heating profile corresponding to a vaporization of one or more constituents of the aerosol generating material.

Optionally, the first property is relatable to a temperature of the aerosol generating material.

Optionally, the heater is an induction heater for inductive heating of the aerosol generating material in use, and the apparatus is arranged to monitor a first property of the inductive heating of the aerosol generating material, thereby to determine the heating profile of the aerosol generating material.

Optionally, the first property comprises a property of the induction heater.

Optionally, the first property comprises a temperature of a susceptor of the induction heater.

Optionally, the first property comprises an electrical property of the induction heater.

Optionally, the electrical property comprises a property indicative of a current supplied to an inductor of the induction heater.

Optionally, the first property comprises a frequency characteristic of a resonance drive circuit of the induction heater.

Optionally, the frequency characteristic comprises a resonant frequency of the resonance drive circuit.

Optionally, the inductive heating has a substantially constant inductive heating power.

Optionally, the apparatus is arranged to: determine a rate of change of the first property; and identify the one or more features of the heating profile on the basis of the determined rate of change of the first property.

Optionally, the one or more features comprise a portion of the heating profile in which the first property remains substantially constant.

Optionally, the characteristic comprises a temperature of the aerosol generating material.

Optionally, the one or more features comprise a second portion of the heating profile in which the first property changes immediately following a or the first portion of the heating profile in which the first property remains substantially constant.

Optionally, the characteristic comprises an end point of vaporization of one or more of the constituents of the aerosol generating material.

Optionally, the apparatus is arranged to: control the heater based on the one or more determined characteristics.

Optionally, the apparatus is arranged to: determine, based on the determined characteristic, that an end point of vaporization of one or more constituents of the aerosol generating material has been reached; and responsive to the determination that an end point of vaporization of one or more constituents of the aerosol generating material has been reached, control the heater.

Optionally, the apparatus is arranged to: control the heater to further heat the aerosol generating material a predefined amount.

Optionally, the apparatus is arranged to: control the supply of a predetermined amount of energy to the aerosol generating material.

Optionally, the apparatus is arranged to present information to a user based on the determined characteristic.

Optionally, the apparatus is arranged to present information to a user relating to one or more constituents of the aerosol generating material based on the determined characteristic.

Optionally, the apparatus is arranged to present information to a user relating to an environment in which the device is being operated based on the determined characteristic.

Optionally, one of the one or more constituents of the aerosol generating material is a liquid.

According to a second aspect of the present invention, there is provided an aerosol generating device comprising: the apparatus according to the first aspect; and the heater.

Optionally, the heater is an induction heater, and the induction heater comprises: a or the inductor; and a or the susceptor arranged for inductive energy transfer with the inductor, the susceptor being arranged for heating of the aerosol generating material received in the aerosol generating device in use.

Optionally, the aerosol generating device comprises: the aerosol generating material.

Optionally, a mass of the heater is lower than a mass of the aerosol generating material.

According to a third aspect of the present invention, there is provided a method for determining a characteristic of an aerosol generating material of an aerosol generating device, the aerosol generating device comprising a heater for heating of the aerosol generating material in use, the method comprising: monitoring a first property of the heating of the aerosol generating material, thereby to determine a heating profile of the aerosol generating material; analysing the heating profile to identify a feature of the heating profile corresponding to a heating of one or more constituents of the aerosol generating material; and determining, based on the identified one or more features, the characteristic of the aerosol generating material.

According to a fourth aspect of the present invention, there is provided a program which when executed on a processor causes the processor to perform the method according to the third aspect.

Further features and advantages will become apparent from the following description, given by way of example only, with reference to the accompanying drawings.

DETAILED DESCRIPTION

Induction heating is a process of heating an electrically conducting object (or susceptor) by electromagnetic induction. An induction heater may comprise an induction element, such as an electromagnet, and circuitry for passing a varying electric current, such as an alternating electric current, through the electromagnet. The varying electric current in the electromagnet produces a varying magnetic field. The varying magnetic field penetrates a susceptor suitably positioned with respect to the electromagnet, generating eddy currents inside the susceptor. The susceptor has electrical resistance to the eddy currents, and hence the flow of the eddy currents against this resistance causes the susceptor to be heated by Joule heating. In cases whether the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field.

In inductive heating, as compared to heating by conduction for example, heat is generated inside the susceptor, allowing for rapid heating. Further, there need not be any physical contact between the inductive heater and the susceptor, allowing for enhanced freedom in construction and application.

An induction heater may comprise an RLC circuit, comprising a resistance (R) provided by a resistor, an inductance (L) provided in part by an induction element, for example the electromagnet which may be arranged to inductively heat a susceptor, and a capacitance (C) provided by a capacitor, connected in series. In some cases, resistance is provided by the ohmic resistance of parts of the circuit connecting the inductor and the capacitor, and hence the RLC circuit need not necessarily include a resistor as such. Such a circuit may be referred to, for example as an LC circuit. RLC and LC circuits may exhibit electrical resonance, which occurs at a particular resonant frequency when the imaginary parts of impedances or admittances of circuit elements cancel each other. Resonance occurs in an RLC or LC circuit because the collapsing magnetic field of the inductor generates an electric current in its windings that charges the capacitor, while the discharging capacitor provides an electric current that builds the magnetic field in the inductor. In these circuits described above, when the circuit is driven at the resonant frequency, the series impedance of the inductor and the capacitor is at a minimum, and circuit current is maximum. Driving the RLC or LC circuit at or near the resonant frequency may therefore provide for effective and/or efficient inductive heating.

Figure 1:
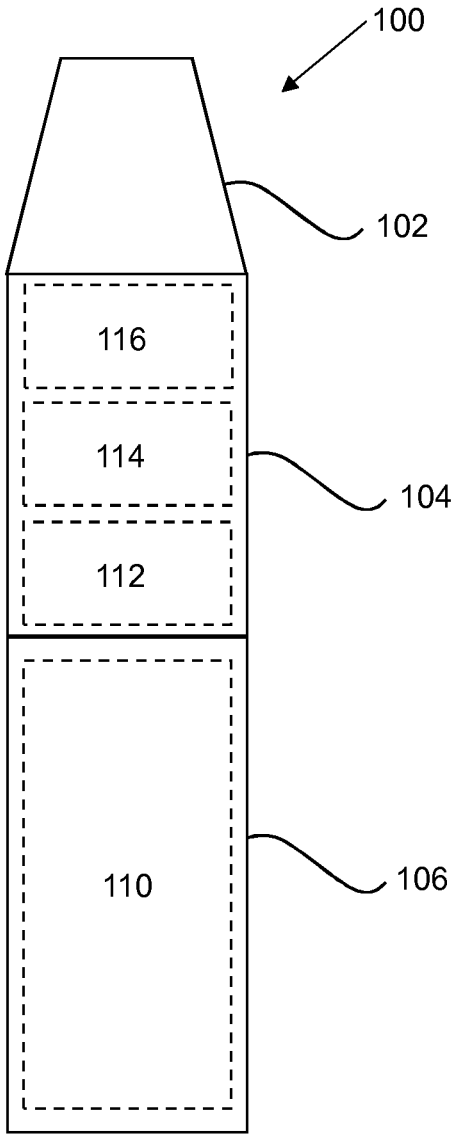
FIG. 1 illustrates schematically an aerosol generating device according to an example.

FIG. 1 illustrates schematically an aerosol generating device 100 according to an example. The aerosol generating device 100 is hand-held. The aerosol generating device 100 comprises a battery portion 106, an aerosol generating portion 104, and a mouthpiece portion 102. The aerosol generating portion 104 comprises a controller 112, an induction heater 114, and aerosol generating material 116. The aerosol generating material 116 may be removable and/or replaceable in the aerosol generating device 100, for example via a cartridge (not shown) that is removably connected to the aerosol generating device 100. The battery portion 106 comprises a battery 110. The battery 110 is arranged to power the induction heater 114. The induction heater 114 is arranged to inductively heat the aerosol generating material 116 in use. The controller 112 is arranged to control the induction heating provided by the induction heater 114. The aerosol generating device 100 is arranged to heat the aerosol generating material 116 to generate aerosol for inhalation by a user via the mouthpiece portion 102.

The aerosol generating material 116 may include materials that provide volatilised components upon heating, typically in the form of vapour or an aerosol. The aerosol generating material 116 may be a non-tobacco-containing material or a tobacco-containing material. Aerosol generating material may, for example, include one or more of tobacco per se, tobacco derivatives, expanded tobacco, reconstituted tobacco, tobacco extract, homogenised tobacco or tobacco substitutes. The aerosol generating material can be in the form of ground tobacco, cut rag tobacco, extruded tobacco, reconstituted tobacco, reconstituted material, liquid, gel, gelled sheet, powder, or agglomerates, or the like. Aerosol generating material also may include other, non-tobacco, products, which, depending on the product, may or may not contain nicotine. Aerosol generating material may comprise one or more humectants, such as glycerol or propylene glycol. In some examples, the aerosol generating material 116 may comprise two or more constituents different from one another. For example, the aerosol generating material 116 may have a first constituent having a first phase, and a second constituent having a second phase. For example, the aerosol generating material 116 may comprise a constituent in solid form and a constituent in liquid form (at ambient temperatures and pressures). For example, the aerosol generating material 116 may comprise tobacco containing material comprising, for example tobacco in solid form and one or more constituents in liquid form, such as water and/or humectants or the like. The working temperature of the aerosol generating device (i.e. the temperature to which the aerosol generating material 116 is heated in use in order to generate aerosol) may be higher than a vaporization or boiling temperature of one of the one or more constituents of the aerosol generating material 116, for example higher than a vaporization or boiling temperature of a liquid constituent of the aerosol generating material 116, for example, higher than the boiling temperature of water. The liquid content, for example the water content, of the aerosol generating material 116, may vary between batches, uses, and or types of aerosol generating material 116 and/or may be dependent on the external environment in which the aerosol generating material 116 is present.

In use, a user may activate, for example via a button (not shown) or a puff detector (not shown) which is known per se, the controller 112 to cause the induction heater 114 to heat the aerosol generating material 116, which causes the aerosol generating material 116 to generate an aerosol. The aerosol is generated into air drawn into the device 100 from an air inlet (not shown), and is thereby carried to the mouthpiece 102, where the aerosol exits the device 100.

The induction heater 114 and/or the device 100 as a whole may be arranged to heat the aerosol generating material 116 to a range of temperatures to volatilise at least one constituent of the aerosol generating material without combusting the aerosol generating material. For example, the temperature range may be about 50° C. to about 350° C., such as between about 50° C. and about 250° C., or between about 50° C. and about 150° C. In some examples, the temperature range is between about 170° C. and about 220° C. In some examples, the temperature range may be other than this range, and the upper limit of the temperature range may be greater than 350° C.

Figure 2:
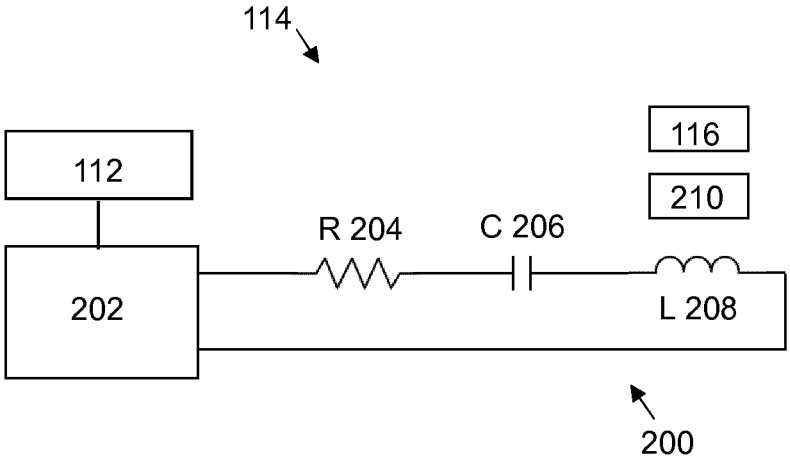
FIG. 2 illustrates schematically an induction heater according to an example.

Referring now to FIG. 2, there is illustrated an induction heater 114 that may be used in the aerosol generating device 100, according to an example. The induction heater 114 comprises an RLC resonance circuit 200 for inductive heating of a susceptor 210. The resonance circuit 200 comprises a resistor 204, a capacitor 206, and an inductor 208 connected in series. The resonance circuit 200 has a resistance R, an inductance L and a capacitance C. The inductor 208 is arranged for inductive energy transfer to the susceptor 210. The susceptor 210 is arranged to heat the aerosol generating material 116. In some examples, the susceptor 210 may be provided with the aerosol generating material 116, and the susceptor 210 and aerosol generating material 116 may be provided in a cartridge (not shown) that is removably connected to the overall device 100, for example to allow replacement of the cartridge (not shown).

The inductance L of the circuit 200 is provided by the inductor 208 arranged for inductive heating of the susceptor 210. The inductive heating of the susceptor 210 is via an alternating magnetic field generated by the inductor 108, which as mentioned above induces Joule heating and/or magnetic hysteresis losses in the susceptor 210. A portion of the inductance L of circuit 200 may be due to the magnetic permeability of the susceptor 210. The alternating magnetic field generated by the inductor 208 is generated by an alternating current flowing through the inductor 208. The alternating current flowing through the inductor 208 is an alternating current flowing through the RLC resonance circuit 200. The inductor 208 may, for example, be in the form of a coiled wire.

The capacitance C of the circuit 200 is provided by the capacitor 206. The resistance R of the circuit 200 may be provided by the resistor 204, the resistance of the wire connecting the components of the resonance circuit 200, the resistance of the inductor 208, and/or the resistance to current flowing in the resonance circuit 200 provided by the susceptor 210 arranged for inductive energy transfer with the inductor 108. It will be appreciated that the circuit 200 need not necessarily comprise a resistor 204, and that the resistance R in the circuit 200 may be provided by the resistance of the connecting wire, the inductor 208 and/or the susceptor 210.

The alternating current is driven in the circuit 200 by a suitable driving circuitry 202, for example, a H-Bridge driver 202 or another varying or alternating current source. The driving circuitry 202 is controllable by the controller 112 to provide an alternating current in the resonance circuit 200. The driving circuitry 202 is connected to a DC voltage supply from the battery 110. For example, the driving circuitry 202 may provide an alternating current in the circuit 100 from the DC voltage supply of the battery 110 by reversing (and then restoring) the voltage across the circuit via switching components (not shown). This may be useful as it allows the RLC resonance circuit to be powered by a DC battery, and allows the frequency of the alternating current to be controlled.

The driving circuitry 202 is connected to a controller 112. The controller 112 controls the driving circuitry 202 or components thereof (not shown) to provide an alternating current I in the RLC resonance circuit 200 at a given drive frequency f. The drive frequency f may be controlled to be at or around the resonant frequency $f_r$ of the particular RLC circuit 200, for example.

It is desirable to determine characteristics of the aerosol generating material 116, for example characteristics of the aerosol generating material 116 during inductive heating of the aerosol generating material 116. For example, it may be useful to determine, or calibrate a determination of, the temperature of the aerosol generating material 116, for example so as to allow for accurate control of the heating of the aerosol generating material 116. As another example, it may be useful to determine when, during heating, water or other constituents of the aerosol generating material 116, have been vaporized, or to determine when an end point of a vaporization of a constituent of the aerosol generating material 116 has been reached, as this may allow for improved control of further heating of the aerosol generating material up to vaporization temperatures of one or more other constituents. For example, aerosol generating material 116 may comprise varying water content which may vary greatly depending on many factors such as manufacturing processes, external environment, etc. Determining when, during heating, substantially all of the water has been vaporized from the aerosol generating material 116, may allow for control of the further heating of the aerosol generating material independent of the initial water content, and hence allow for a more consistent aerosol deliver, as well as more efficient heating control, for example. For example, the point where water has been completed vaporized may infer that a certain amount of additional energy is then required to reach the vaporization temperature of the other constituents.

According to examples of the present invention, an apparatus (for example the controller 112), is arranged to determine a characteristic of the aerosol generating material 116 during heating of the aerosol generating material 116. In broad overview, and as described in more detail below, the controller 112 is arranged to monitor a first property P of the inductive heating of the aerosol generating material 116, thereby to determine a heating profile of the aerosol generating material 116. The controller 112 is arranged to analyse the heating profile to identify a feature of the heating profile corresponding to a heating (for example a vaporization) of one or more constituents of the aerosol generating material 116. The controller 112 is arranged to determine, based on the identified one or more features, the characteristic of the aerosol generating material. For example, the characteristic may be a temperature of the aerosol generating material 116, and/or an end point of vaporization of a constituent (e.g. water) of the aerosol generating material 116. As explained in more detail below, determining such characteristics may allow for an accurate determination of the temperature of the aerosol generating material, and/or for improved control of further heating of the aerosol generating material 116, for example.

As mentioned above, the controller 112 is arranged to monitor a first property P of the inductive heating of the aerosol generating material 116, thereby to determine a heating profile of the aerosol generating material 116.

Figure 3:
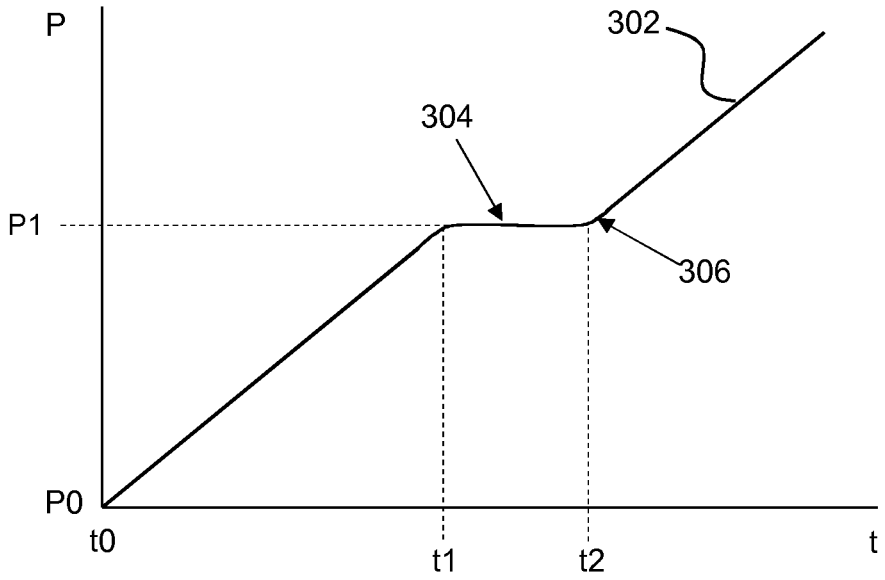
FIG. 3 illustrates a heating profile according to an example.

Referring now to FIG. 3, there is illustrated schematically an example heating profile 302 of the aerosol generating material 116. The heating profile 302 corresponds to a value of the first property P of the inductive heating of the aerosol generating material 116 as a function of time t. As the induction heater 114 heats the aerosol generating material 116, the first property P of the inductive heating changes as a function of time t. The first property P may be recorded continuously or discretely by the controller 112 as a function of time t, for example in a storage or memory (not shown).

In some examples, the first property P is relatable to a temperature of the aerosol generating material 116. For example, the property P may be a measured temperature of the aerosol generating material 116. For example, the temperature of the aerosol generating material 116 may be sensed by a separate temperature sensor (not shown) positioned at or near the aerosol generating material 116. The controller 112 may be communicatively coupled with the temperature sensor (not shown), and may collect temperature data from the temperature sensor (not shown) so as to monitor the temperature of the aerosol generating material 116 as a function of time t.

In some examples, the first property P is a property of the induction heater 114. For example, the first property P may comprise a temperature of the susceptor 210 of the induction heater 114. For example, a temperature sensor (not shown) may be placed at or near the susceptor 210. In this regard, it should be appreciated that the temperature of the susceptor 210 may be a function of the heating of the aerosol generating material 116. The controller 112 may be communicatively coupled with the temperature sensor (not shown), and may collect temperature data from the temperature sensor (not shown) so as to monitor the temperature of the susceptor 210 as a function of time t. Since the susceptor 210 is arranged for heating the aerosol generating material 116, for example it may be in thermal contact or close thermal contact with the aerosol generating material 116, the determined temperature of the susceptor may be the same or similar to the temperature of the aerosol generating material 116, or at least a portion of the aerosol generating material 116.

The first property P need not necessarily be a direct temperature measurement of the susceptor 210 and/or the aerosol generating material 116 by a separate temperature sensor (not shown). For example, in some examples, the first property P comprises an electrical property of the induction heater 114 (or more generally the circuit 200), which may be indicative of the temperature of the susceptor 210 and/or the aerosol generating material 116.

In one example, the first property P comprises a property indicative of the current I supplied to the inductor 208 of the induction heater 114. As described above, the battery 110 may supply a DC voltage (and substantially DC current) to the drive circuitry 202, which then provides an alternating current to the resonance circuit 200 comprising the inductor 208. As the temperature of the susceptor 210 increases by inductive heating, the properties of the susceptor 210 (e.g., the ohmic resistance of the susceptor 210) may change. Purely by way of example only, the ohmic resistance of the susceptor 210 may increase with temperature. The increase of the ohmic resistance of the susceptor 210 may in turn increase the overall effective resistance R of the resonant circuit 200. Hence, by Ohms law, for a given DC supply voltage, for example supplied by the battery 110, as the effective resistance R of the resonant circuit 200 increases, the current I drawn from the battery 110 by the drive circuitry 202 will decrease, the current I flowing in the resonant circuit 200 will decrease, and hence the current I supplied to the inductor 208 will decrease. Hence the current I supplied to the inductor 208 of the induction heater 114 may be relatable to the relative temperature of the susceptor 210, and may be used as a first property P of the inductive heating of the aerosol generating material 116.

The current I drawn from the battery 110 by the drive circuitry 202 and/or the current I flowing in the resonant circuit 200 and/or the current I supplied to the inductor may be monitored by the controller 112 in a number of ways. For example, the current I may be measured passively or actively. For example, a current meter (not shown) may be applied on a supply line (not shown) between the battery 110 and the drive circuitry 202, to measure the current drawn by the drive circuitry 202. This measurement may be provided to the controller 112, which may monitor the current I as the first property P, as a function of time t. As another example, a pick-up coil (not shown) may be placed in proximity with the inductor 208, and a voltage meter (not shown) may be used to measure the voltage induced across the pick-up coil (not shown) by the inductor 208. The induced voltage may be proportional to the current I flowing in the resonance circuit 200, and provided to the inductor 208. The induced voltage is therefore an example of a property indicative of the current I supplied to the inductor 208 of the induction heater 114. The measured induced voltage may be provided to the controller 112, which may monitor the induced voltage and/or convert the induced voltage into a measure of the current I flowing in the resonance circuit 200, as the first property P.

It should be appreciated that in other implementations, an electrical property of the circuit 200 other than the current I may be measured as the first property P.

In some examples, the first property P comprises a frequency characteristic of the resonance circuit 200 of the induction heater 114.

For example, the frequency characteristic may comprise a resonant frequency $f_r$ of the resonance drive circuit 200. The resonant frequency $f_r$ of the circuit 200 may be dependent on the capacitance C and inductance L of the circuit 200, and may be given by:

$$f_r = \frac{1}{2\pi\sqrt{LC}} \tag{1}$$

The inductance L of the inductor 208 and hence of the resonance circuit 200 is dependent on the magnetic permeability μ of the susceptor 210. Magnetic permeability μ is a measure of the ability of a material to support the formation of a magnetic field within itself, and expresses the degree of magnetization that a material obtains in response to an applied magnetic field. The greater the magnetic permeability μ of the susceptor 210, the greater the inductance L. The magnetic permeability μ of a material from which the susceptor 116 is comprised may change with temperature. For example, for susceptors comprising ferromagnetic and ferrimagnetic materials operating below their Curie temperature $T_c$ for example, as the temperature of the susceptor 210 increases, the magnetic permeability μ of the susceptor 210 will decrease and hence the inductance L in the resonance circuit 200 will decrease, and hence, via equation (1), the resonant frequency $f_r$ of the resonant circuit 200 will decrease. Hence the resonant frequency $f_r$ of the resonant circuit 200 of the induction heater 114 may be relatable to the relative temperature of the susceptor 210, and may be used as a first property P of the inductive heating of the aerosol generating material 116.

The resonant frequency $f_r$ of the resonance circuit 200 may be measured using any suitable means. At the resonant frequency $f_r$, the series impedance Z of the inductor 208 and the capacitor 206 is at a minimum, and hence the circuit current I is maximum. The resonant frequency $f_r$ of the circuit 200 may be determined by the controller 112 being arranged to measure a frequency response of the resonance circuit 200. For example, the controller 112 may be arranged to intermittently measure the current I flowing in the RLC circuit 100 (or a parameter relatable to the current I flowing in the RLC circuit 200 as described above) as a function of the driving frequency fat which the RLC circuit is driven. For example, the controller 112 may be arranged to control the drive circuitry 202 to scan through a range of drive frequencies f. The current I flowing in the circuit 200 (or a parameter relatable thereto) may be measured during the scan of drive frequencies, and hence the frequency response of the RLC circuit 200 as a function of the driving frequency f may be determined. The resonant frequency $f_r$ may then be determined from the frequency response as the frequency f at which the current I flowing in the circuit 200 is a maximum, for example. This process can be repeated over time to obtain a variation of frequency f (as the first property P) as a function of time t.

Referring again to FIG. 3, the first property P of the inductive heating of the aerosol generating material is monitored as a function of time t, thereby to determine the heating profile 302 of the aerosol generating material 116. For ease of explanation, it is assumed in the following description of FIG. 3 that the first property P is directly proportional to the temperature of the aerosol generating material, although it will be appreciated that, as described above, in other examples any first property P of the inductive heating of the aerosol generating material may be used. Further, for ease of explanation, it is assumed in the following description of FIG. 3 that the power of the inductive heating (i.e. the rate of energy supplied to the aerosol generating material by inductive heating) remains substantially constant over the heating profile 302, although it will be appreciated that, as described in more detail below, this need not necessarily be the case and that in other examples (not shown) the inductive heating power may vary.

In the example illustrated in FIG. 3, at time to, the first property P is at some initial value $P_0$, corresponding to some initial temperature of the aerosol generating material 116. As the inductive heating begins (in this example with a constant heating power), the first property P increases as a function of time t between $t_0$ and $t_1$. This corresponds to the temperature of the aerosol generating material 116 increasing, as the energy applied to the aerosol generating material 116 by the susceptor 210 increases the temperature of the aerosol generating material 116. However, at time $t_1$, the first property P substantially ceases to rise (which may include increasing at a different rate/a substantially reduced rate), and instead stays substantially constant at a value of $P_1$ between times $t_2$ and $t_3$. In other words, there is a portion 304 of the heating profile between $t_1$ and $t_2$ in which the first property P stays substantially constant (plateaus) as a function of time t.

The first property P stays constant between times t1 and t2 due to the latent heat of vaporization of a constituent of the aerosol generating material. This latent heat is the energy supplied to the constituent of the aerosol generating material 116 at its boiling point to change its phase (e.g. liquid to gas) without changing its temperature. In other words, the first property P stays substantially constant because, although the aerosol generating material 116 is still being inductively heated (in this example still being heated with a constant heating power), the energy supplied to the aerosol generating material is, instead of increasing the temperature of the aerosol generating material 116, being used to vaporize a constituent of the aerosol generating material 116. As one example, the constituent may be water, which has a known boiling point of 100° C. It may therefore be accurately determined that between times $t_1$ and $t_2$ where the first property remains substantially constant at $P_1$, that the temperature of the aerosol generating material 116 is 100° C., i.e. that the value $P_1$ of the first property P corresponds to a temperature of the aerosol generating material 116 of 100° C.

At time $t_2$, the first property P begins to increase again, which corresponds to an increase in the temperature of the aerosol generating material 116. The first property P increases at $t_2$ due to all or substantially all of the constituent of the aerosol generating material 116 having been vaporized, and hence the inductive heating of the aerosol generating material 116 once again increasing the temperature of the aerosol generating material 116. A portion 306 of the heating profile 302 at which the first property P beings to increase again, immediately after the portion 304 in which the first property P remains substantially constant, may correspond, for example, to the end point of vaporization of the constituent of the aerosol generating material. For example, the constituent may be water, and it may be accurately determined that at $t_2$ all or substantially all of the water of the aerosol generating material 116 has been vaporized, and that e.g. the water content of the aerosol generating material at time t2 is substantially zero, for example.

As mentioned above, the apparatus (e.g. controller 112) is arranged to analyse the heating profile 302 to identify a feature of the heating profile 302 corresponding to a vaporization of one or more constituents of the aerosol generating material 116. The apparatus (e.g. controller 112) is arranged to determine, based on the identified one or more features, the characteristic of the aerosol generating material 116. For example, the controller 112 may comprise a processor (not shown) and a memory (not shown). The processor may, for example, extract heating profile data stored in the memory, and process the data so as to perform the analysis of the heating profile, and/or the determination of the characteristic. It should be appreciated that the heating profile data comprises at least two data points representing the first property P at two different times, which can then be used to calculate a change of the first property P.

In some examples, the feature of the heating profile 302 comprises the portion 304 of the heating profile 302 in which the first property P remains substantially constant. The controller 112 may determine, based on an identification of the feature of the first property P remaining substantially constant, a temperature of the aerosol generating material. For example, as described above, the constituent may be water, which has a known boiling point of 100° C., and hence on identification of the feature of the first property P remaining substantially constant, the controller 112 may determine that the temperature of the aerosol generating material 116 is approximately 100° C.

In some examples, a mass of the heater 114, for example the mass of the susceptor 210 of the induction heater 114, may be larger than the mass of the aerosol generating material 116. This may help ensure that the first property P is accurately relatable to the temperature of the aerosol generating material. For example, this may help ensure that the feature of the first property P remaining substantially constant is readily identifiable, which may help improve the reliability and/or accuracy of the determination of the features of the heating profile and hence the characteristics of the aerosol generating material 116. Further, the power of the inductive heating provided may be so as to allow the feature of the heating profile to be readily identifiable. For example, where the feature is a portion 304 where the first property P stays substantially constant, the power of the inductive heating provided may be such that the time between times t1 and t2 is large enough to allow the portion 304 to be readily identified. As will be appreciated, a power of inductive heating which allows the feature of the heating profile to be readily identifiable may be dependent on the mass and/or the type of aerosol generating material used and/or a mass and/or type of the susceptor used to heat the aerosol generating material.

The aerosol generating material 116 may comprise other known vaporizable constituents. For example, it may be known that the aerosol generating material 116 comprises a plurality of, for example two, known vaporizable constituents. It may be known, for example, that a first of the constituents has a boiling point of X° C., and that a second of the constituents has a boiling point of Y° C., where X° C. is lower than Y° C. Hence, on heating of the aerosol generating material, the controller 112 may determine that, when a first portion of the heating profile (not shown) in which the first property P remains substantially constant is reached, the temperature of the aerosol generating material is X° C., and when a second portion of the heating profile (not shown) in which the first property P remains substantially constant is reached, the temperature of the aerosol generating material is Y° C., for example. The controller 112 may therefore reliably and accurately determine the temperature of the aerosol generating material 116. This may offer a more reliable temperature determination as compared to, for example, direct temperature measurement using a temperature sensor, as this method may be less susceptible to calibration error, for example.

As another example, the one or more features may comprise the second portion 306 of the heating profile 302 in which the first property P changes immediately following the first portion 304 of the heating profile 302 in which the first property P remains substantially constant. The controller 112 may determine, based on the identification of such a feature, an end point of vaporization of one or more of the constituents of the aerosol generating material 116. For example, as described above, the constituent may be water, and it may be accurately determined that when the first property begins to rise again immediately following a portion in which the first property P remains substantially constant, that an end point of the vaporization of water has been reached, i.e. that all or substantially all of the water of the aerosol generating material 116 has been vaporized. It may therefore be determined, for example, that the water content of the aerosol generating material 112 at this point is substantially zero. This may allow for improved control of further heating of the aerosol generating material 116, as described in more detail below.

In some examples, the controller 112 may be arranged to control the induction heater 114 based on the one or more determined characteristics. For example, the controller 112 may control the induction heater 114 to increase or decrease an inductive heating power, and/or to apply a different heating power, and/or to control the inductive heater 114 to cease to provide inductive heating, and/or to control the inductive heater 114 to provide inductive heating according to a predefined control pattern or sequence, and/or to provide a predefined further inductive heating and/or further predefined amount of energy to the aerosol generating material 116. The controller 112 may control the inductive heater 114, for example, by controlling a current supplied to the drive means 202, or by controlling a drive frequency f of the drive circuitry 202.

As described above, the determined characteristic may be a temperature of the aerosol generating material 116. The controller 112 may control the induction heater 114 based on the determined temperature of the aerosol generating material. For example, the controller 112 may control the induction heater 114 according to a predefined control sequence or particular heating profile once a given temperature (e.g. corresponding to the boiling point of a known constituent) is determined to have been reached. This may, for example, help to prevent overheating of the aerosol generating material.

As another example, as described above, the determined characteristic may be an end point of vaporization of a constituent of the aerosol generating material. The controller 112 may be arranged to determine that an end point of vaporization of one or more constituents of the aerosol generating material has been reached, and responsive to the determination that an end point of vaporization of one or more constituents of the aerosol generating material has been reached, control the induction heater. For example, the controller 112 may control the induction heater 114 to further inductively heat the aerosol generating material 116 a predefined amount. For example, the controller 112 may control the supply of a predetermined amount of energy to the aerosol generating material 116.

For example, different aerosol generating materials 116 that may be used with the aerosol generating device 100, or different batches of the same aerosol generating material 116 that may be used (e.g. successively used) with the aerosol generating device 100, may comprise varying water content (or varying content of other constituents). Determining a point, during heating, at which all of the water (or other constituent) has been vaporized from the aerosol generating material 116, allows for control of the further heating of the aerosol generating material independent of the initial water (or other constituent) content, and hence may allow for a more consistent aerosol delivery, as well as more efficient heating control. In other words, the variation due to water is eliminated (or substantially reduced) and hence the controller 112 may supply a set amount of power to the susceptor 210/aerosol generating material 116 from the point at which water is substantially vaporized. This means that the operational temperature can be reached with more accuracy.

For example, the additional energy required, after the water (or other constituent) has been vaporized, to increase the temperature of the aerosol generating material 116 to a given operating temperature (e.g. to an optimum temperature at which the aerosol generating material 116 generated aerosol) may be predetermined, and the controller 112 may control the induction heater 114 to supply that predetermined amount of energy to the aerosol generating material 116. This may allow for simpler and/or more accurate control of the induction heating. For example, control may be made independent of an initial constituent (e.g. water) content of the aerosol generating material, which may vary between uses, batches, or types etc of the aerosol generating material. This may allow that at least a portion of the inductive heating control may be applied more accurately as compared for example to control in which these variations are not taken into account, and/or more simply as compared for example to control in which these variations are taken into account over a whole control range, for example. The controller 112 may therefore allow for improved control of inductive heating of aerosol generating material, and for an improved aerosol generating device 100.

In another example, the controller 112 may be configured to present information to the user based on the determined characteristic of the aerosol generating material 116. For example, where the determined characteristic is indicative that all of the water (or other constituent) has been vaporized from the aerosol generating material 116, the user may be provided with information indicative of this. In another example, the information presented to the user may be indicative of a temperature of the aerosol generating material 116. For example, the information may inform the user that the aerosol generating material 116 is at the boiling temperature of water when the determined characteristic is indicative that all of the water has been vaporized from the aerosol generating material 116. In other examples, the user may be presented with information related to a composition of the aerosol generating material 116. For example, information relating to the composition of the aerosol generating material 116 may be determined based on analysis of the heating profile 302. For example, analysis of the heating profile may reveal the presence in the aerosol generating material 116 of first and second vaporizable constituents having different boiling points, as discussed above. The user may therefore be presented with information indicating that these constituents are present in the aerosol generating material 116. The controller 112 may further, in some examples, determine if the aerosol generating material 116 is a material which is approved for use with the device 100 based on the determined information relating to the composition of the aerosol generating material 116. In examples, the controller 112 may present such information to the user and/or the controller 112 may be configured to take an action, such as determining whether to allow operation of the device 100 to heat the aerosol generating material 116 based on if the aerosol generating material 116 is approved for use with the device 100. In another example, the controller 112 may be configured to determine, based on the determined characteristic of the aerosol generating material 116, a parameter relating to an environment in which the device 100 is being operated. For example, the controller 112 may determine an amount of water in the aerosol generating material 116 based on a feature of the heating profile 302. In examples, the amount of water in the aerosol generating material 116 may be indicative of a humidity of the environment in which the device 100 is being operated. The user may therefore, for example, be presented with information relating to a humidity of the environment.

Figure 4:
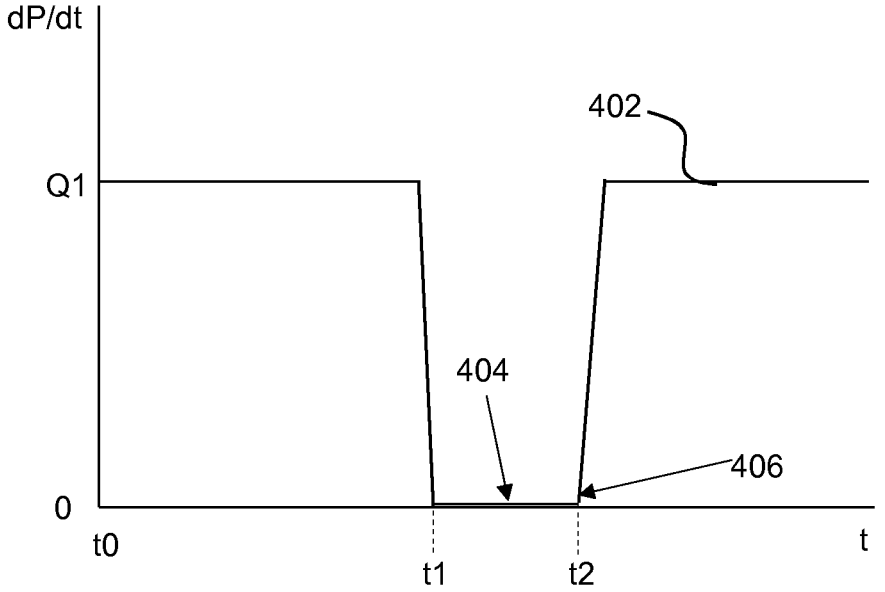
FIG. 4 illustrates schematically a plot of the rate of change of an induction heating property according to an example.

In some examples, the controller 112 is arranged to determine a rate of change of the first property P, for example a rate of change of the first property as a function of time. The controller 112 may be arranged to identify the one or more features of the heating profile on the basis of the determined rate of change of the first property. FIG. 4 illustrates schematically a plot 402 of the rate of change dP/dt of the first property P as a function of time t. As with FIG. 3, it is assumed in FIG. 4 that the inductive heating has a constant heating power, and that the property P is directly proportional to a temperature of the aerosol generating material 116. At time $t_0$, induction heating begins, and the rate of change dP/dt (i.e. in this example the first derivative of the first property P with respect to time t) is at a value $Q_1$. This remains the case until at time $t_1$, the rate of change dP/dt reduces to substantially zero, where it remains until $t_2$. This indicates that, in the portion 404 of the plot 402 in the time range $t_1$ to $t_2$, the property P does not substantially change, i.e. remains substantially constant, as a function of time t. As described above, it may be determined from this, for example, that a constituent (e.g. water) has reaches its boiling (or vaporization) point, and hence that the temperature of the aerosol generating material 116 at this point is the boiling (or vaporization) point of the constituent, for example 100° C. for water. At time $t_2$, in a second portion 406 of the plot 402, the rate of change dP/dt increases again. This indicates that the property P has begun again to increase (immediately following the portion 404 where the property P has remained substantially constant), and hence the controller 112 may determine form this, as described above, that the end point of vaporization of the constituent (e.g. water) of the aerosol generating material 116 has been reached. The controller 112 may perform the control of the induction heater 114 as described above on the basis of such a determination. Identifying the one or more features of the heating profile on the basis of a determined rate of change of the first property P may allow for sensitive identification by the controller 112 of the relevant changes in the first property P, and hence for reliable and accurate control.

Figure 5:
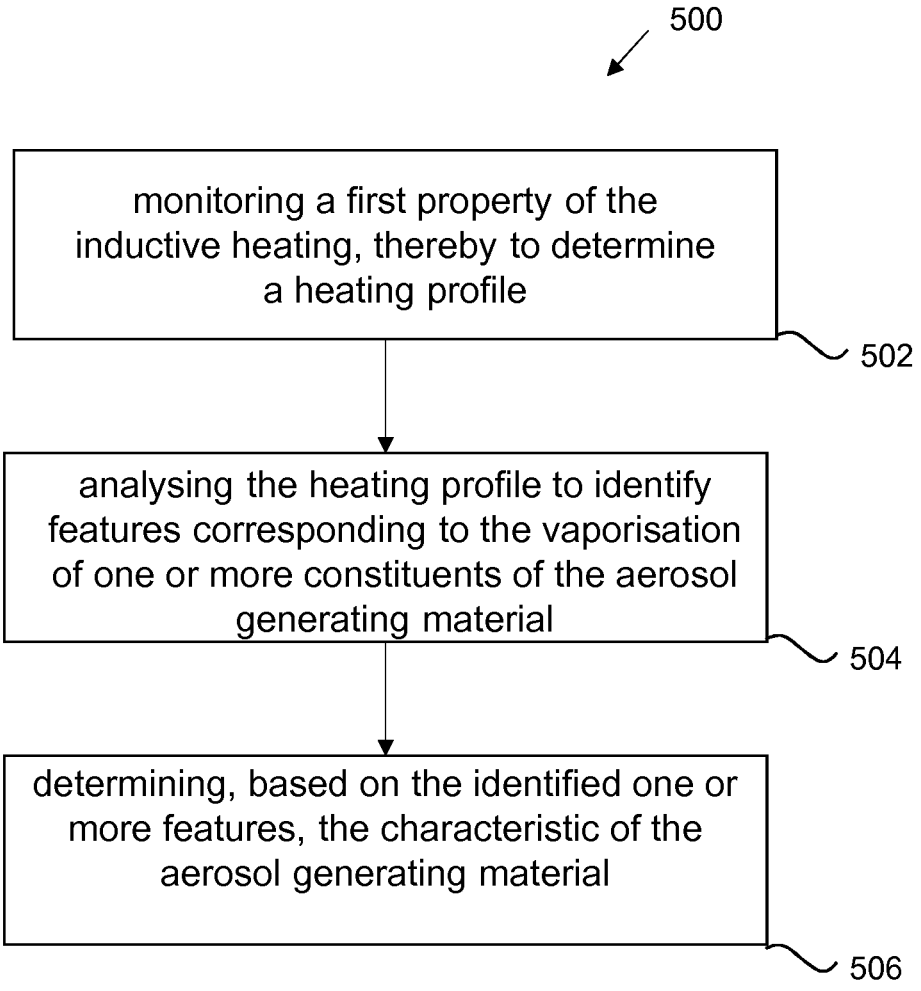
FIG. 5 illustrates schematically a flow diagram of a method according to an example.

FIG. 5 illustrates schematically a method for determining a characteristic of the aerosol generating material 116 of the aerosol generating device 100. As mentioned above, the aerosol generating device 100 comprises an induction heater 114 for inductive heating of the aerosol generating 116 material in use. The method may be performed, for example, by an apparatus, for example the controller 112 of the aerosol generating device 100. The controller 112 (or other apparatus) may comprise a processor (not shown) and a memory (not shown). The memory (not shown) may have instructions (e.g. a computer program) stored thereon which when executed by the processor (not shown) causes the controller 112 (or other apparatus) to perform the method.

In step 502, the method comprises monitoring a first property P of the inductive heating of the aerosol generating material 116, thereby to determine a heating profile of the aerosol generating material 116. In some examples, the first property P may be any of the first properties P described above. The heating profile may be, for example, similar to that described above with reference to FIG. 3.

In step 504, the method comprises analysing the heating profile to identify a feature of the heating profile corresponding to a vaporization of one or more constituents of the aerosol generating material. As described above, the feature may comprise a portion in which the first property P remains substantially constant (e.g. indicating the vaporization of a constituent), and/or a portion in which the first property P changes immediately following the portion in which the first property remains substantially constant (e.g. indicating an end point of vaporization of the constituent).

In step 506, the method comprises determining, based on the identified one or more features, the characteristic of the aerosol generating material. As described above, the characteristic may be, for example, a temperature of the aerosol generating material 116 and/or an end point of the vaporization of a constituent of the aerosol generating material 116. Although not illustrated in FIG. 5, the method may comprise controlling the inductive heating on the basis of the determined characteristic, for example as described above.

In some examples, the monitoring of the first property P of the inductive heating thereby to determine a heating profile, and the analysing the heating profile to identify a feature corresponding to the vaporization of one or more constituents of the aerosol generating material 116, may occur substantially successively or may occur substantially concurrently (i.e. simultaneously). For example, the analysis of the heating profile may occur as the monitoring of the first property is taking place, i.e. in real time. For example, the analysis may be conducted for a present value of the first property and one or more values of the first property P determined or recorded immediately previously to the present value of the first property P. Performing the monitoring and the analysis substantially concurrently may allow for a responsive determination of the characteristic of the aerosol generating material 116, and may allow for a responsive and hence more accurate and reliable control of the aerosol generating device 100.

In some of the above examples, it was assumed that the first property P was directly proportional to a temperature of the aerosol generating material. However, it will be appreciated that this need not necessarily be the case and that in other examples the first property P may have other dependencies on the temperature of the aerosol generating material, but that nonetheless the heating profile may be analysed to identify a feature of the heating profile corresponding to a vaporization of one or more constituents of the aerosol generating material.

In some of the above examples, it was assumed that the inductive heating was performed with a constant inductive heating power. However, it will be appreciated that the aerosol generating material 116 need not necessarily be heated with a constant inductive heating power in order for the characteristic to be determined, and that in other examples variable inductive heating power may be used. Similarly, it will be appreciated that the first property P need not necessarily be monitored as a direct function of time tin order to determine a heating profile, i.e. it will be appreciated that the heating profile determined need not necessarily be the first property P as a direct function of time t. For example, in other examples, the first property P may be monitored as a function of an energy E supplied to the aerosol generating material 116, and/or consumed by the inductive heater 114, for example. The heating profile may therefore comprise the first property P as a function of the energy E supplied to the aerosol generating material 116, and/or energy consumed by the inductive heater 114. The energy E may be determined, for example, by multiplying the electrical power provided to (i.e. consumed by) the induction heater 114 (which may be, for example, the same or similar or proportional to the inductive heating power provided by the induction heater 104) by the time t that the power has been provided for. Similarly to as for the above examples, when a constituent of the aerosol generating material 116 begins to vaporize, the first property P may remain substantially constant as a function of the energy E provided because the energy E, instead of increasing the temperature of the aerosol generating material, is used to vaporize the constituent of the aerosol generating material. Hence, for example, at this point, a temperature of the aerosol generating material 116 may be accurately determined as the boiling point (or vaporization point) of the constituent. Similarly, when the first property P increases immediately after a portion where the first property has remained substantially constant, it may be determined that an end point of vaporization of the constituent has been reached. As above, control of further heating by the induction heater 114 may then be controlled on the basis of this point having been reached.

In some of the above examples, it is described that the apparatus for determining the characteristic of the aerosol generating material 116 is the controller 112 of the aerosol generating device 100. However, it will be appreciated that this need not necessarily be the case, and that in other examples, the apparatus may not be an internal or integral component of an aerosol generating device 100, and may be provided for example, as a separate apparatus.

In a further example, the feature of the first property P may be used to identify the aerosol generating material 116 and/or determine if the aerosol generating material 116 is intended for use with the aerosol generating device 100. For example, the controller may determine that the aerosol generating material 116 is not to be used with the aerosol generating device 100. This could be based on identifying the aerosol generating material explicitly (e.g., by name or constituents) or by comparing the feature of the first property P to an expected feature (e.g., stored in advance). If the measured feature of the first property P is different to the expected feature, then the controller may prevent the heating of the aerosol generating material 116 or may provide a warning to the user of the device 100.

In some of the above examples, it is described that the aerosol generating device comprises an induction heater for inductive heating of the aerosol generating material in use, and that the apparatus is arranged to monitor a first property of the inductive heating of the aerosol generating material to determine a heating profile of the aerosol generating material. However, it will be appreciated that this need not necessarily be the case, and that in some examples the aerosol generating device may comprise any heater for heating of the aerosol generating material in use, and the apparatus may be arranged to monitor a first property of the heating of the aerosol generating material, thereby to determine the heating profile of the aerosol generating material. For example, in some examples, the heater may be a resistive heater and the first property may be, for example, a temperature of the aerosol generating material measured by a temperature sensor, for example as described above.

In some of the above examples, it is described that the apparatus analyses the heating profile to identify a feature of the heating profile corresponding to a vaporization of one or more constituents of the aerosol generating material. However, it will be appreciated that this need not necessarily be the case, and that in some examples the apparatus may analyse the heating profile to identify a feature of the heating profile corresponding (more generically) to a heating of one or more constituents of the aerosol generating material. For example, apart from a vaporization of one or more constituents of the aerosol generating material, the feature of the heating profile may be, for example, a certain heating gradient (e.g. a rate at which one or more constituents of the aerosol generating material is heating up). The identified heating gradient may then be used, for example to determine a characteristic of the aerosol generating material. For example, different constituents of the aerosol generating material may have different heat capacities, which may affect the heating gradient identified. Therefore, a characteristic of the aerosol generating material may be an identity of a constituent of the aerosol generating material and/or e.g. a type of aerosol generating material. As another example, different amounts of a certain aerosol generating material (or constituents thereof) may result in different observed heating gradients. Therefore, a characteristic of the aerosol generating material may be a (current) amount of aerosol generating material (or constituent thereof). It will be appreciated that other features of the heating profile corresponding to a heating of one or more constituents of the aerosol generating material may be identified and used to determine a characteristic of the aerosol generating material.

In another example, the apparatus may analyse the heating profile to identify a feature of the heating profile corresponding to a vaporization of one or more constituents of the aerosol generating material using gradients relating to different portions of the heating profile. For example, prior to a constituent, such as water, being vaporized from the aerosol generating material, the heating profile may have a first gradient M1. However, after all of the water in the aerosol generating material has been vaporized, the heating profile may have a second gradient M2. In this example, the second gradient M2 will be larger than the first gradient M1 since at the point in the heating profile having the gradient M2, the aerosol generating material 116 requires less energy to raise its temperature by a given amount since there is water no longer is being heated. A point at which tangents to the heating profile having gradients M1 and M2 could be determined in order to determine an inflection point in the heating profile. The feature of the heating profile corresponding to a vaporization of one or more constituents of the aerosol generating material can thereby be determined. This may be useful if the inflection point is not readily identifiable by other techniques, for example if the induction heating power is high such that the inflection point is short-lived.

It should be noted that it is a feature of the heating profile of the aerosol generating material itself that is identified so as to determine a characteristic of the aerosol generating material. Therefore, while in some examples a property of the (induction) heater may be monitored to determine the heating profile of the aerosol generating material, it is nonetheless a feature of the heating profile corresponding to a heating of the one or more constituents of the aerosol generating material that is identified in order to determine the characteristic of the aerosol generating material. This may be, for example, as opposed to some feature of the heater (e.g. the susceptor of an inductive heater) itself. Identifying a feature of the heating profile corresponding to a heating of the one or more constituents of the aerosol generating material in order to determine the characteristic of the aerosol generating material may allow for characteristics specific to the aerosol generating material being heated to be determined, which has benefits for example described hereinbefore, such as improved consistency and control of heating.

The above examples are to be understood as illustrative examples of the invention. It is to be understood that any feature described in relation to any one example may be used alone, or in combination with other features described, and may also be used in combination with one or more features of any other of the examples, or any combination of any other of the other examples. Furthermore, equivalents and modifications not described above may also be employed without departing from the scope of the invention, which is defined in the accompanying claims.

The invention claimed is:

1. An apparatus for determining a characteristic of an aerosol generating material of an aerosol generating device, the aerosol generating device comprising:

a heater for heating of the aerosol generating material in use, the apparatus being arranged to:

monitor a first property of the heating of the aerosol generating material, thereby to determine a heating profile of the aerosol generating material;

analyse the heating profile to identify a feature of the heating profile corresponding to a heating of one or more constituents of the aerosol generating material; and determine, based on the identified one or more features, the characteristic of the aerosol generating material, wherein the characteristic comprises a temperature of the aerosol generating material or an end point of vaporization of one or more of the constituents of the aerosol generating material.

2. The apparatus according to claim 1, wherein the apparatus is arranged to analyse the heating profile to identify a feature of the heating profile corresponding to a vaporisation of one or more constituents of the aerosol generating material.

3. The apparatus according to claim 1, wherein the first property is relatable to a temperature of the aerosol generating material.

4. The apparatus according to any one of claim 1, wherein the heater is an induction heater for inductive heating of the aerosol generating material in use, and the apparatus is arranged to monitor a first property of the inductive heating of the aerosol generating material, thereby to determine the heating profile of the aerosol generating material.

5. The apparatus according to 4, wherein the first property comprises a property of the induction heater.

6. The apparatus according to claim 5, wherein the first property comprises a temperature of a susceptor of the induction heater.

7. The apparatus according to claim 5, wherein the first property comprises an electrical property of the induction heater.

8. The apparatus according to claim 7, wherein the electrical property comprises a property indicative of a current supplied to an inductor of the induction heater.

9. The apparatus according to claim 5, wherein the first property comprises a frequency characteristic of a resonance drive circuit of the induction heater.

10. The apparatus according to claim 9, wherein the frequency characteristic comprises a resonant frequency of the resonance drive circuit.

11. The apparatus according to claim 4, wherein the inductive heating has a substantially constant inductive heating power.

12. The apparatus according to claim 1, wherein the apparatus is arranged to:

determine a rate of change of the first property; and identify the one or more features of the heating profile on the basis of the determined rate of change of the first property.

13. The apparatus according to claim 1, wherein the one or more features comprise a portion of the heating profile in which the first property remains substantially constant.

14. The apparatus according to claim 1, wherein the one or more features comprise a second portion of the heating profile in which the first property changes immediately following a or the first portion of the heating profile in which the first property remains substantially constant.

15. The apparatus according to claim 1, wherein the apparatus is arranged to:

control the heater based on the one or more determined characteristics.

16. The apparatus according to claim 15, wherein the apparatus is arranged to:

determine, based on the determined characteristic, that an end point of vaporisation of one or more constituents of the aerosol generating material has been reached; and responsive to the determination that an end point of vaporisation of one or more constituents of the aerosol generating material has been reached, control the heater.

17. The apparatus according to claim 16, wherein the apparatus is arranged to:

control the heater to further heat the aerosol generating material a predefined amount.

18. The apparatus according to claim 17, wherein the apparatus is arranged to:

control the supply of a predetermined amount of energy to the aerosol generating material.

19. The apparatus according to claim 1, wherein the apparatus is arranged to:

present information to a user based on the determined characteristic.

20. The apparatus according to claim 19, wherein the apparatus is arranged to:

present information to a user relating to one or more constituents of the aerosol generating material based on the determined characteristic.

21. The apparatus according to claim 18, wherein the apparatus is arranged to:

present information to a user relating to an environment in which the device is being operated based on the determined characteristic.

22. The apparatus according to claim 1, wherein one of the one or more constituents of the aerosol generating material is a liquid.

23. An aerosol generating device comprising:

the apparatus according to claim 1; and a heater.

24. The aerosol generating device according to claim 23, wherein the heater is an induction heater, and the induction heater comprises:

an inductor; and a susceptor arranged for inductive energy transfer with the inductor, the susceptor being arranged for heating of the aerosol generating material received in the aerosol generating device in use.

25. The aerosol generating device according to claim 23, wherein the aerosol generating device comprises:

an aerosol generating material.

26. The aerosol generating device according to claim 25, wherein a mass of the heater is lower than a mass of the aerosol generating material.

27. A method for determining a characteristic of an aerosol generating material of an aerosol generating device, the aerosol generating device comprising a heater for heating of the aerosol generating material in use, the method comprising:

monitoring a first property of the heating of the aerosol generating material, thereby to determine a heating profile of the aerosol generating material;

analysing the heating profile to identify a feature of the heating profile corresponding to a heating of one or more constituents of the aerosol generating material; and determining, based on the identified one or more features, the characteristic of the aerosol generating material, wherein the characteristic comprises one of a temperature of the aerosol generating material or an end point of vaporization of one or more of the constituents of the aerosol generating material.

28. The method of claim 27, wherein the method is executed on a processor causes the processor to perform the method according to claim 27.

* * * * *